US005906279A

United States Patent [19]

Bergholtz et al.

[11] Patent Number: 5,906,279

[45] Date of Patent: May 25, 1999

[54] STACK OF NESTING BEAKER-LIKE CONTAINERS

[75] Inventors: Lars Bergholtz, Seeheim-Jugenheim; Rista Brkovic, Darmstadt; Michael Ruh, Heusenstamm, all of Germany

[73] Assignee: Tetra Laval Holdings & Finance S.A., Sweden

[21] Appl. No.: 08/849,261

[22] PCT Filed: Sep. 21, 1995

[86] PCT No.: PCT/EP95/03718

§ 371 Date: Jul. 22, 1997

§ 102(e) Date: Jul. 22, 1997

[87] PCT Pub. No.: WO96/15949

PCT Pub. Date: May 30, 1996

[30] Foreign Application Priority Data

Nov. 20, 1994 [DE] Germany ..... 44 41 284

[51] Int. Cl.[6] ..... B01D 35/00

[52] U.S. Cl. ..... 206/515; 206/517; 220/666

[58] Field of Search ..... 220/666, 657, 220/671, 23.83; 206/515, 517; 229/400, 405

[56] References Cited

U.S. PATENT DOCUMENTS

| | | | |
|---|---|---|---|
| 1,765,182 | 6/1930 | Tomkins . | |
| 1,886,171 | 1/1932 | Dodge et al. | 206/517 |
| 2,937,786 | 5/1960 | Muller . | |
| 4,362,623 | 12/1982 | Holopainen | 206/515 |
| 5,267,685 | 12/1993 | Sorensen . | |
| 5,325,993 | 7/1994 | Cooper . | |

FOREIGN PATENT DOCUMENTS

| | | |
|---|---|---|
| 94300504 | 1/1994 | European Pat. Off. . |
| 7912794 | 5/1979 | France . |
| 1918169 | 6/1965 | Germany . |
| 2822772 | 5/1978 | Germany . |
| 3342510 | 11/1983 | Germany . |
| 8705541 | 4/1987 | Germany . |
| 4201097 | 1/1992 | Germany . |
| 474418 | 6/1968 | Switzerland . |
| 875810 | 5/1958 | United Kingdom . |
| 1306050 | 1/1970 | United Kingdom . |
| 2199559 | 4/1987 | United Kingdom . |
| 2278590 | 6/1993 | United Kingdom . |

*Primary Examiner*—Steven Pollard
*Attorney, Agent, or Firm*—Paul & Paul

[57] ABSTRACT

A stack (31) of cup-shaped containers (2, 4, 6) coaxially inserted one inside another is described, each with a side wall (32) on one end of which a base (33) is arranged, and on the other end a flange (1), wherein the container (2, 4, 6) is composed of a flexible material and the flange (1) is substantially stiffer than the side wall (32) and the base (33). In order to make such a stack (31) more easy to manufacture and to take apart, it is provided according to the invention that apart from the outermost cup-shaped container (4), each inner container (2) is partially radially folded, and that the degree of folding gradually increases towards the innermost cup-shaped container (2).

16 Claims, 4 Drawing Sheets

Figure 1:
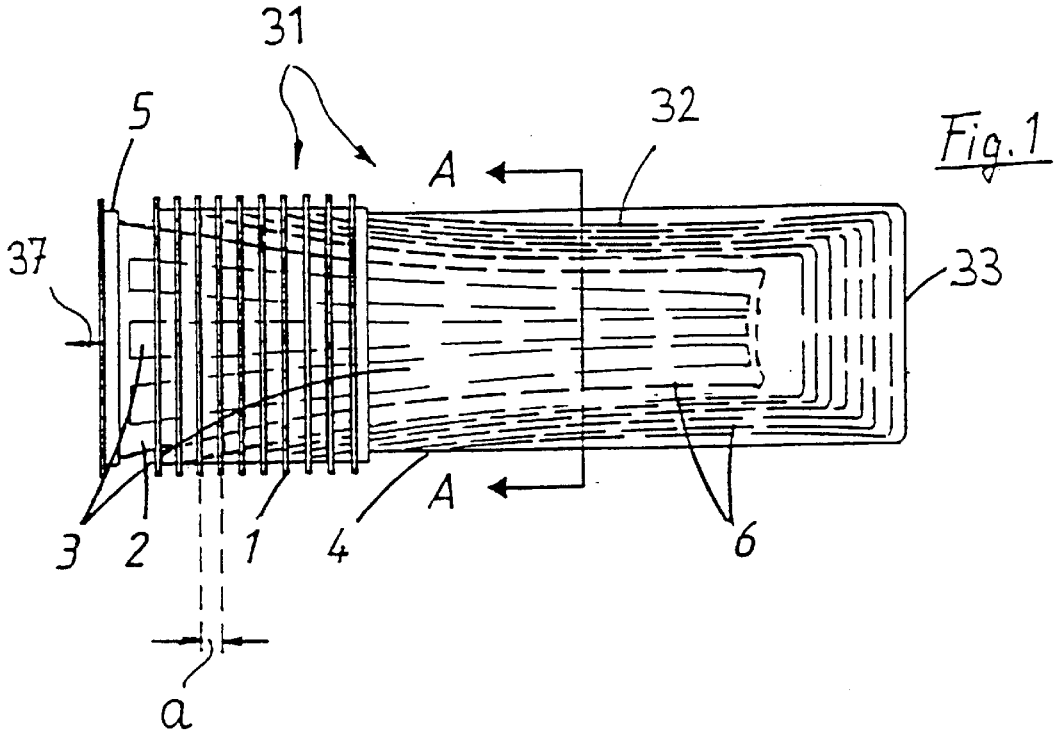

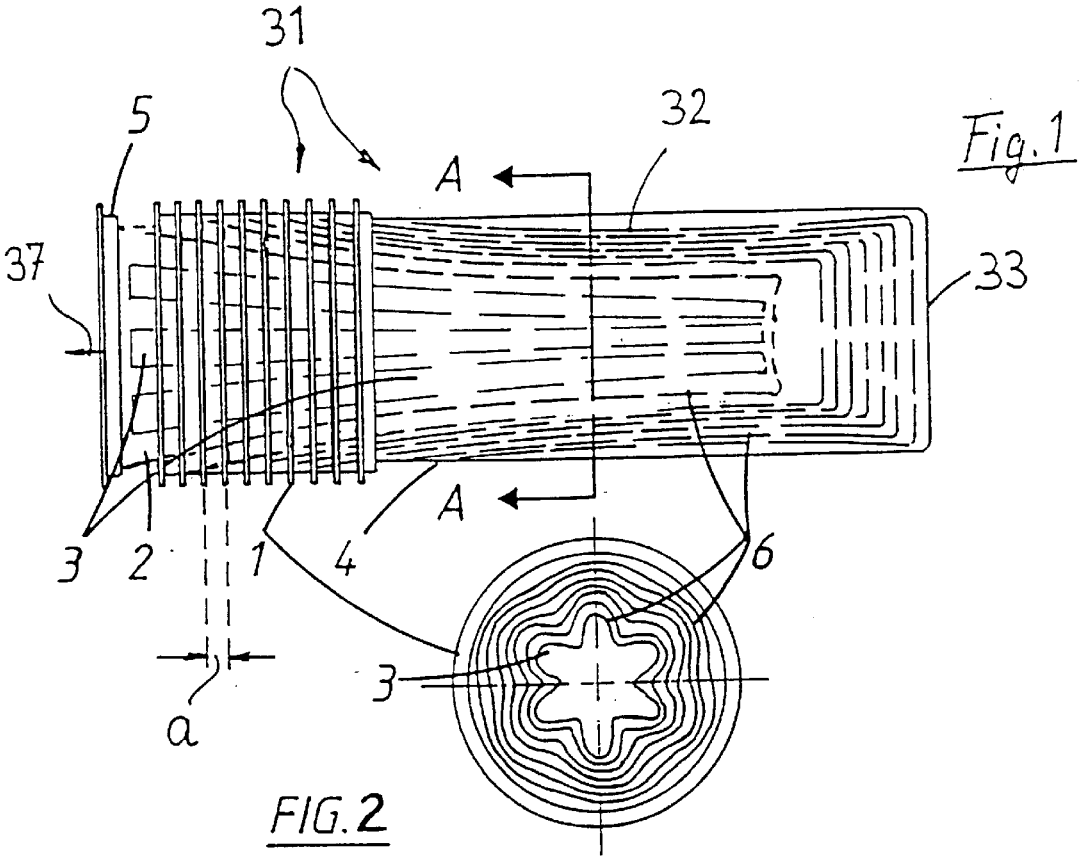
Fig. 1
FIG. 2
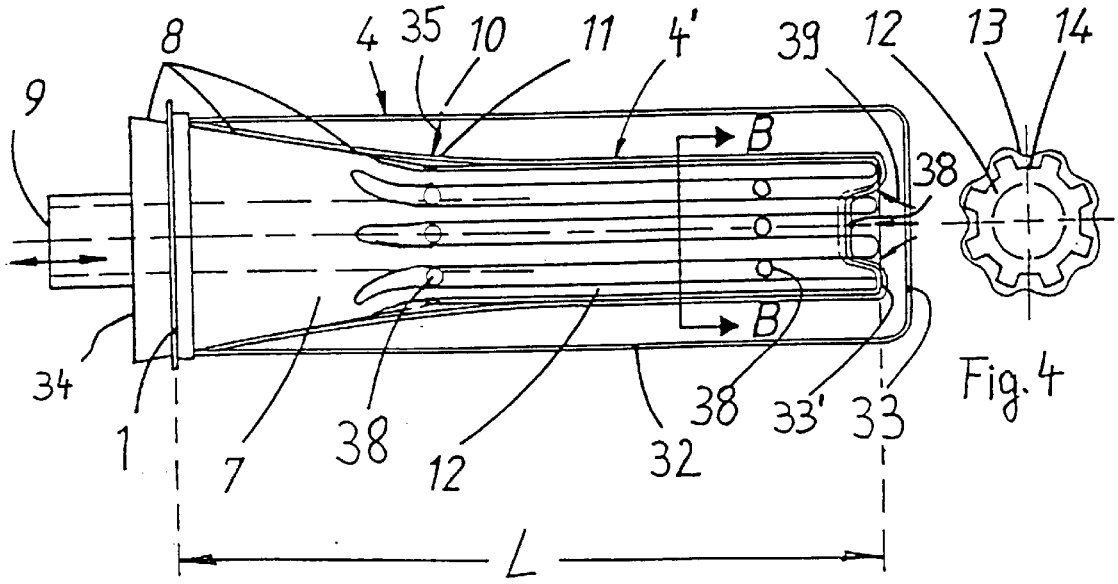
Fig. 4
FIG. 3

STACK OF NESTING BEAKER-LIKE CONTAINERS

The invention relates to a stack of cup-shaped containers coaxially inserted one inside another, each with a side wall, on one end of which a base is arranged, and on the other end a flange, wherein the container is composed of a flexible material and the flange is substantially stiffer than the side wall and the base. The invention further relates to a method for manufacturing such a stack, a method for de-stacking such containers and a device for implementing the stacking and de-stacking.

Stacks of empty disposable drinking cups are known, which are transported by the manufacturer inserted one inside another either for filling or to the end user. These stacks of containers inserted one inside another are either de-stacked at high speed in a filling machine or removed individually by the end user, often from a specially constructed container dispenser.

Cup-shaped containers for stacking coaxially one inside another and forming a stack had, until now, to have certain geometrical configurations and sizes, in particular they had to have conical walls of a generally truncated conical shape and have a collar and a rigid flange in the wall adjacent to the open end of the container, on the one hand for being able to take hold of and manipulate the containers for stacking, and on the other hand for de-stacking said containers.

The length and density of the packaging in stacks of known containers inserted one inside another depends, inter alia, upon the length of the cup-shaped container, upon the thickness of its walls, and upon the cone or taper angle of the container. These known containers can only be inserted one inside another and combined into a stack until the conical walls are solidly and tightly folded. In most cases the collar described is necessary to keep the containers stacked one inside another at a sufficient distance apart from one another and thereby to also prevent wedging of one container into the next and thereby to prevent jamming and sticking due to friction. Using a sufficiently large collar such a stack can be better taken apart, that is to say the individual cup-shaped containers can be better de-stacked or better dispensed from a suitable dispenser. It has been shown that the transport and space requirements as well as the costs are higher the lower the stack density, the greater the distance from one flange of the containers to the other flange of the next container, and thereby the stacking distance, and the smaller the cone angle of the side wall of the container.

For this reason, attempts have already be made to reduce the distance of known containers from one another in a stack, and a limit encountered of a minimum distance apart of the containers amounting to approximately 5% of the total length of the cup-shaped container. This means that a substantial part of the transported volume is air between the cup-shaped containers in the stack, making a minimum of storage space unavoidable.

With separating devices, automated dispensers or the like for de-stacking conventional cup containers, it is necessary to withhold the stack and to release only the container located at the outermost free end. For this, specific mechanical retaining means and mechanisms for releasing the container located on the end of the stack are necessary, which cannot be manufactured and operated without additional costs and correspondingly complicated technology.

Other hollow containers such as, for example, foodstuff or drinks cans have a cone angle of 0 or, in other words, have a cylindrical side wall, so that they cannot be made into a stack. During transport and storage of such containers there are therefore additional costs for the transport of empty containers, because besides the materials for the containers there is relatively large weight of transporting equipment to be moved. In order to avoid this, the production plants for such cup-shaped containers have been positioned near to the food processing and filling points. This presents undesirable secondary conditions which could be avoided if cup-shaped containers with different geometrical configurations could be combined into the stack and be separated therefrom.

Another category of hollow containers are foldable or collapsible bags, which are manufactured from a plastics foil or from paper, and folded flat and transported in this folded or collapsed form. Such containers again require a complex and expensive apparatus in order to unfold and erect them in a filling machine. Furthermore, they often retain creases from the flat piling and stacking and the geometry for transport caused by this, and when they are erected they often have a warped or twisted shape.

Containers made from flexible plastics material with a stiff flange are not stackable using the means of the known technologies. When it is attempted to stack them one inside another, they crumple immediately.

The object of the present invention is therefore to provide a stack of the type described in the introduction which is easier to manufacture and can also be taken apart, wherein preferably a larger number of different cup-shaped containers can be stacked and de-stacked; and also to provide a method and a device for producing such stacks.

According to the invention, this object is solved in that except for the outermost cup-shaped container, each inner container is partly radially folded, and that the degree of the folding gradually increases towards the innermost cup-shaped container. By means of these measures according to the invention cup-shaped containers made from flexible material with a stiff flange can be coaxially tightly inserted inside one another, and a stack obtained in which many of the disadvantages described hereinabove are avoided. The novel concept of the invention is based on the fact that the stack is assembled by folding or collapsing the individual cup-shaped containers. The space inside the stack which is in any case not required is exploited according to the invention in order to gradually increasingly fold, or collapse in an undulating manner, the containers, proceeding from the second outermost cup-shaped container towards the inside, so that a kind of crumple zone forms in the area of the side wall of the stacked container. While with conventional stacks made from cup-shaped containers the space for the side walls inserted one next to another is produced by an enlargement of the length of the stack and reduction of the stacking density, the invention uses the internal space, which in itself is superfluous, to receive the side walls and this happens only in that the respective side wall is collapsed in radially corrugated folds prior to stacking. The inserting of the containers one inside another is possible, despite the expectations of the experts, because the respective outermost container is widened and/or the volume of the next inner container shrunk.

It is also advantageous when according to the invention, each inner cup-shaped container has longitudinal folds in its side wall, distributed about its circumference, and a flange at the open end. By means of such folding of the cup-shaped container, after de-stacking, when the cup-shaped container again has its manufactured geometric configuration, that is to say the expanded shape, no significant bends, folds or other surface flaws remain. By means of the type of folding or collapsing according to the invention of the cup-shaped containers, no stamping and therefore also no sharp edges, are required. As a result, after separation and expansion of the cup-shaped container, there are no weaknesses on the surface and also no damaged areas, and during collapsing no parts causing damage to adjacent walls are formed.

With some embodiments, the function of the flange is that the stack can be particularly easily and well formed with its assistance. Because of its stiffness, which is greater relative to the side wall and the base, a suitable tool, a machine part or in the case of use by the end user, the user's hand, can grip the flange and thereby manipulate and move the container in a defined manner. For the manufacturer, the flange also offers a good means of defining the shape and size of the cross-section of the cup-shaped container.

With another embodiment and type of stacking (hereinafter, the example with a vacuum and compressed air will be described) the flange does not have to be used for gripping and moving the container, but instead acts as a seal. In this way the space inside the cup-shaped container can be sealed from the exterior and compressed air or a vacuum introduced and thereby the folding of the side walls affected.

It is further advantageous according to the invention when the longitudinal folds in the side wall of the cup-shaped container begin at its open end and extend as far as the base, and when the average diameter of the respective inner container of a stack is smaller, because of the folding and the geometrical configuration altered as a result, than the average diameter of the adjacent outer container. The outermost container has no folds at all. Because of the pushing in of the next inner cup-shaped container, a certain pressure is exerted outwards by this inner container, so that any folds in the outermost container are eliminated. In contrast, the inner container concerned is folded, as are further inner containers. They are collapsed in a corrugated manner and crumpled with an increasing degree of folding towards the inside, with the exception of the flange which, because of its stiffness must not and cannot be folded. From this flange, according to the invention, the longitudinal folds run to its base, wherein the average diameter of the inner containers continuously reduces towards the interior of the stack.

It is further to be noted that, naturally, this does not relate to cup-shaped containers which have different diameters in the manufactured condition. The stack according to the invention relates to containers with the same diameter within a stack. By means of the folding, this fact is, so to speak, corrected, in order to provide improved space for the containers inserted one inside another.

By means of this reduction in diameter towards the innermost container in the stack, yet a further advantageous effect is obtained: The respective innermost cup-shaped container is the easiest to pull out, and always individually, from the stack of containers. This is because the force of withdrawal is always lowest only for the innermost container and is approximately double for the next outer container. In other words, the containers located further outside in a stack are always more resistant to being pulled out from the inside.

The side wall of the respective inner container presses outwards, even when it has longitudinal folds, and thereby causes friction and tension with respect to the next outer container. If, for example, three cup-shaped containers inserted one inside another are considered, that is to say an inner one, a middle one and an outer one, the walls of the inner and middle containers press against the outer container, whereas the friction between the inner and the middle containers is approximately only half as great, as at that point only the inner container presses against the middle one. As a result, with a stack according to the invention the strength of the resistance of the inner container to being pulled out is markedly less than that of the adjacent outer container. In this way it is ensured that multiple removal is avoided during de-stacking.

De-stacking is further improved for cup-shaped containers of the type described herein, in that according to the invention a lubricant is present on the plastics surface of the cup-shaped container. In this case, lubricant can either be applied externally to the surface outside and/or inside on the side wall after the production of the cup-shaped container, or alternatively the plastics can be chemically treated and provide lubricant on the external surface of the side wall without any separate coating process. For example, the friction-reducing material can be mixed into the wall material of the cup-shaped container. In a further advantageous configuration of the invention, a collar is arranged on the flange of the cup-shaped container towards its side wall. Advantageously in this way the spacing apart of the cup-shaped containers in the axial direction of the stack can be set in a defined manner. The respective flange of the adjacent container is then supported against the collar. If, for example, a somewhat longer collar is used, whereby a larger spacing of consecutive cup-shaped containers in a stack is obtained, larger machine parts can be provided for gripping the flange of the container concerned. If, on the other hand, a smaller space requirement is desired for the stack, the length of the collar is reduced or completely omitted. The stack according to the invention can then be configured in a very short and compact manner.

Nevertheless, it must be noted that in practice the total number of cup-shaped containers which can be inserted inside one another, and therefore the length of the stack, is limited. With very long collars, and thereby with a large flange spacing—when ever larger flange distances are desired—the stack can be configured with an infinite length. However, the invention averts such impractical embodiments and to a large extent is not dependent on the collar and its height or on the cone angle of the side wall; it can, in an unexpected manner, combine a large number of cup-shaped containers into a stack, because its internal space is used for the stacking even when in the end with some embodiments the total number of containers combined into a stack is limited, for example stacks of 30 to 50 or preferably stacks of 25 are manufactured and used.

It is furthermore advantageous when the longitudinal folds in the side wall of the cup-shaped container are substantially uniformly distributed about the circumference and are curved in an undulating manner in cross-section. By means of such a measure, the optimum shape for the stacked container can be obtained and in particular corners, folding over or bends are avoided, so that after separation and erection or expansion of the cup-shaped containers no deformations remain and in the walls certainly no surface flaws have occurred. This is particularly important when the cup-shaped container is conceived for receiving liquids.

In an advantageous manner, according to the invention it can be provided that the cup-shaped container in its expanded state has an approximately cylindrical or conically tapered side wall. With the stack according to the invention, containers with different geometrical configurations can be used. For insertion one inside another it was necessary until now for the cup-shaped container to have a minimal cone angle. More precisely, it has been considered necessary that this cone angle be positive, that is to say the truncated cone of the side wall of the container widens towards its opening. Such containers naturally can be combined according to the invention into a stack of the type described herein.

Unexpectedly, in addition the cup-shaped container can also have a cylindrical shape in the state as manufactured or in the expanded state. By folding, channelling, fluting or grooving the side wall of the novel cup-shaped container the average diameter can be reduced such that the side wall can also be cylindrical in shape. If the measures according to the invention are taken into account, it is no longer surprising when in the state as manufactured or in the expanded state, the cup-shaped container even has a truncated cone-shaped side wall, the cone angle of which is negative. In other words, the diameter of the base of the container is larger than the internal diameter of the open side of the side wall. With such an embodiment with the same flange diameter (as with containers with a cylindrical side wall or cone-shaped side wall with a positive cone angle) a larger volume of the container can be used and yet a cup-shaped container configured in this way can be combined into a stack according to the invention.

Hereinafter, the method will be described for manufacturing a stack of cup-shaped containers of the type described in the introduction, and in order to solve the object described hereinabove, this method is characterised in that between the inside and the outside of the side wall of the cup-shaped container a pressure drop is created such that the side wall of the container comes to lie in a folded state on a mandrel, the pressure differential is maintained and during this the mandrel is moved with the folded container on it into a holder, after which the pressure differential is switched, the container expanded, and the empty mandrel removed from the expanded container, after which the procedure is repeated and one container after another is moved into the respective previous inner container.

The folding or the undulating grooving, profiling or fluting of the side wall of the cup-shaped container is obtained pneumatically according to the invention, that is to say by a drop in pressure or in other words a pressure differential between the inside of the side wall and its outside. If a mandrel is used as the holding and transport means for a cup-shaped container to be manipulated or moved, the flexibility of the material of the container allows its side wall to be brought into contact with the mandrel. This is done advantageously, for example, in that on the outside of the cup-shaped container an excess pressure is created which presses the side wall onto the surface of the mandrel and folds it there or folds it in a corrugated manner as desired. In this way, using very simple means, the cup-shaped container is held on the mandrel and can be moved to any point desired while the pressure differential is maintained, for example in a holder, so that the folded up container is also moved into this holder. In order to release the cup-shaped container from the mandrel, which may, for example have a substantially smaller diameter than the holder, the pressure differential is reversed and the cup-shaped container expanded from the inside by the excess pressure. The holder is naturally adjusted and set up for the manufactured geometry of the cup-shaped container so that the container is also properly supported in the holder. The mandrel is then empty and free and can be removed in order to take the next container, for example from a manufacturing machine, and to move it into the holder in which a first cup-shaped container is already located. The latter is then the outer container described above, in which the next one will be inserted, as the inner container. The holder then also supports the inner container by means of the outer container. This procedure is repeated until the stack is completed, wherein in each case the newest container is moved into the inside of the stack, that is to say into the current inner container.

It has proved particularly advantageous in the case of a preferred embodiment when the average diameter of the folded side wall of the cup-shaped container is reduced by the pressure differential by at least 40% of the diameter of the expanded container. With such dimensions, the stack can be manufactured particularly well, and the respective cup-shaped containers can be handled without problems and introduced into the inside of the stack in order to lengthen it. It is evident in this case that this addition to and lengthening of the stack according to the invention cannot continue endlessly, but instead the stacking procedure finds its limit where the side wall of the last inner, container, just re-expanded, comes to lie on the inner side wall of the next outer container already inserted in the stack. When, in other words, there is no longer enough space in the centre of the stack to introduce a further cup-shaped container into the inside of the stack without friction and interference, the limit is reached.

The reverse of the method according to the invention can be used for de-stacking cup-shaped containers of the type described in the introduction. In order to be able to remove and process the containers from the stack properly, using the advantages of the invention, it is provided according to the invention that between the inside and the outside of the side wall of the cup-shaped container a pressure drop is created such that the side wall of the innermost container comes to lie in a folded state on a mandrel, the pressure differential is maintained and during this the mandrel is moved with the folded container on it out of the stack and is transported to a processing station, after which the pressure drop is reversed and the container is expanded to its geometrical configuration as manufactured, after which the empty mandrel is removed from the expanded container, after which the procedure is repeated and one container after another is removed from the stack and transported to the processing station. This is practically the reverse of the stacking process, as was described hereinabove, so that further explanations about the method for de-stacking appear unnecessary. Naturally, the de-stacking procedure is continued until the last container, which was the outer container in the stack, is removed from the holder with the aid of the mandrel and is transported to the processing station.

The measures with respect to folding are also advantageous for the de-stacking method, in that the average diameter of the folded side wall of the cup-shaped container is reduced by the pressure differential by at least 40% of the diameter of the expanded container.

The device for implementing both the stacking and the de-stacking methods is provided with a mandrel and a holder for the cup-shaped containers moveable relative thereto, and for solving the object described hereinabove is characterised in that the mandrel has a first section with a conical surface and a second section with a cylindrical surface, that the length of the conical section is approximately ⅓ of the active length of the mandrel, and that the conical section has a substantially smooth surface. The length of the mandrel is measured in the direction of the longitudinal central axis and is perpendicular to the circular cross-section area of the second cylindrical section. When an "active" length of the mandrel is described, this is understood to be the length of the mandrel which is involved in the actual process. For example, a finger-length mandrel can be imagined, which is conceived for a slim, elongated cup-shaped container. Nevertheless, the mandrel should project somewhat from the cup-shaped container, that is to say the section should protrude from the inside in the area of the open end of the container. The active length of the mandrel is then that which is surrounded by the cup-shaped container. The parts of the mandrel projecting from the cup-shaped container are not involved in the process.

The division of the mandrel into a first conical and a second cylindrical section has the advantage that in the conical section a simple and reliable centring and sealing of the flange is possible, and at the same time the folding of the side wall of the cup-shaped container on the cylindrical section.

It is also particularly advantageous when according to the invention there is provided in the mandrel an air line coming from its end face, which bifurcates at the cylindrical section and opens out into the surface of the cylindrical section. Although the pressure differential can also be easily obtained in that excess pressure is applied from outside and this forces the flexible side wall of the cup-shaped container to lie on the smaller circumference available of the mandrel, it is, however, particularly advantageous when suction is at the same time provided by means of an air line in the mandrel and thereby supports the folding of the flexible side wall of the container in a defined manner. In the area of the conical section the air line then runs further in the inside of the mandrel, so that the conical section can have a smooth surface and can ensure the sealing of the container on the flange side thereof. The evacuated air from the sealed interior of the container then arrives, via the openings in the air line, on the surface of the cylindrical section.

It is furthermore advantageous when according to the invention grooves are arranged in the surface of the cylindrical section, running in the longitudinal direction of the mandrel and distributed symmetrically about its circumference, and when the respective bifurcation of the air line opens out into the base of the groove. The undulating shape of the grooves or of the profiled folding cross-section of the cup-shaped container can be particularly easily controlled. The package density in the stack of cup-shaped containers can then be increased so that it greatly exceeds the package density of conventional stacks of containers, and even approaches the mass density of folded, compressed and flattened bags of similar material.

Furthermore, according to the invention the total circumferential length of the cylindrical and grooved sections of the mandrel can be dimensioned such that the cup-shaped container can be brought to lie on its circumferential length. The circumferential length of the cylindrical section of the mandrel is the cross-section length of the grooves (that is, the width of the base and twice the height of the groove), plus the part of the external circumference of the mandrel located between two grooves, multiplied by the total number of these parts located between the grooves. In the ideal case, all of the side wall material of the cup-shaped container is brought completely into contact with the surface of the mandrel. In other words, the circumferential length of the cup-shaped container is equal to this total circumferential length of the grooved cylindrical section. In practice, there will be small deviations, which, however, make no difference to the advantages and the effect desired according to the invention.

By means of the measures according to the invention, a stack of the type described in the introduction is constructed in that the respective cup-shaped container is previously folded or collapsed, and in this folded or collapsed form is introduced into the holder of the stack and into the outer container, that is to say into the inside of the stack then formed, and is expanded again there. By means of the expansion, space is provided for the next, folded cup-shaped container, which is to be introduced into the stack and removed therefrom.

A flexible material is indicated for the material of the cup-shaped containers combined into the stack according to the invention, wherein the flange is stiffer than the side walls and the base. In a special example, the wall thickness is 80$\mu$. However, containers have already been made according to the invention whose wall thickness is in the region of 20$\mu$ to 30$\mu$. The upper limit of the embodiments used previously as examples was, for the thickness of the side wall of the cup-shaped container, in the region of between 200$\mu$ and 300$\mu$. The flange had—with a special container 145 mm long—a thickness of 1.2 mm. At the open end of the cup-shaped container according to this preferred embodiment, the internal diameter was 48 mm, while the flange diameter was 53 mm externally. The diameter of the base of this container was 44 mm. Tests have already be carried out, however, with containers 250 mm to 300 mm long. The method according to the invention, the stack and also the device are mainly directed, with particularly good results and effects, to long, slim containers.

A flexible but thick, solid plastics material is selected as the material for such cup-shaped containers, wherein good results can be obtained with polyolefin-based plastics, also with paper which was coated with polyolefin, further with softened PVC, with polyamides, or generally with thermoplastic materials.

With some special embodiments a limit has been established for the total of cup-shaped containers which can be tightly packed together according to the invention. This limit depends on the thickness of the wall materials, the size and shape of the cup-shaped containers, on the flexibility of the material of the side wall of the container, and on its surface friction properties. For example, the size of a stack of a stack can vary from approximately ten cup-shaped containers to approximately fifty cup-shaped containers. If this number of containers in the stack is exceeded, it is difficult to introduce a further folded, inner cup-shaped container into a stack, without the present shape of the stack, that is to say the inner wall of the inner container resulting in an undesirable problematic effect.

When the surface friction of the wall material of the cup-shaped container is high, understandably, the number of containers which can be combined into a stack is considerably lower than if the surface friction were low. It is therefore advantageous to provide a lubricant on the surface of the cup-shaped container, wherein either the lubricant is introduced, for example, into the plastics polymer, or, in the case of coated paper, said paper is coated with a lubricant, or a film of external lubricant is applied to the cup-shaped container.

Figures 5, 6, 7, 8:
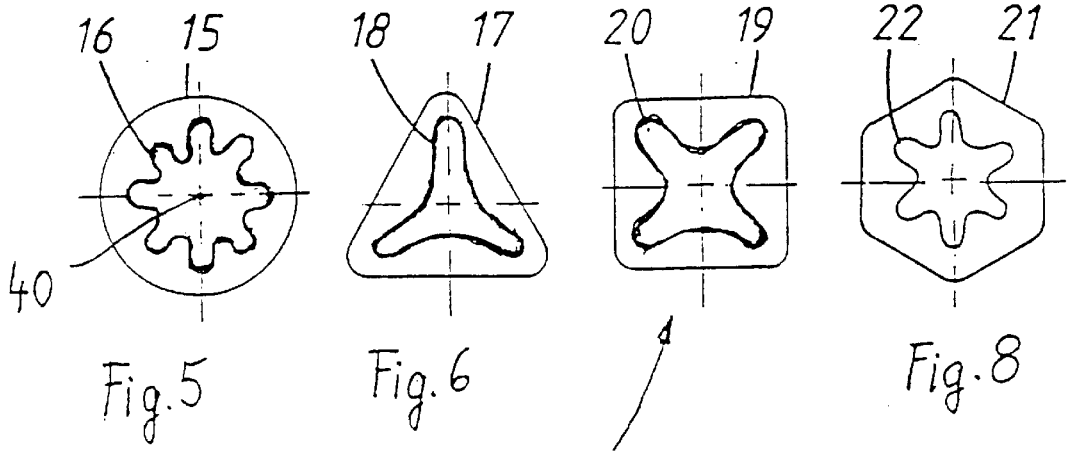
Figures 9, 10, 11:
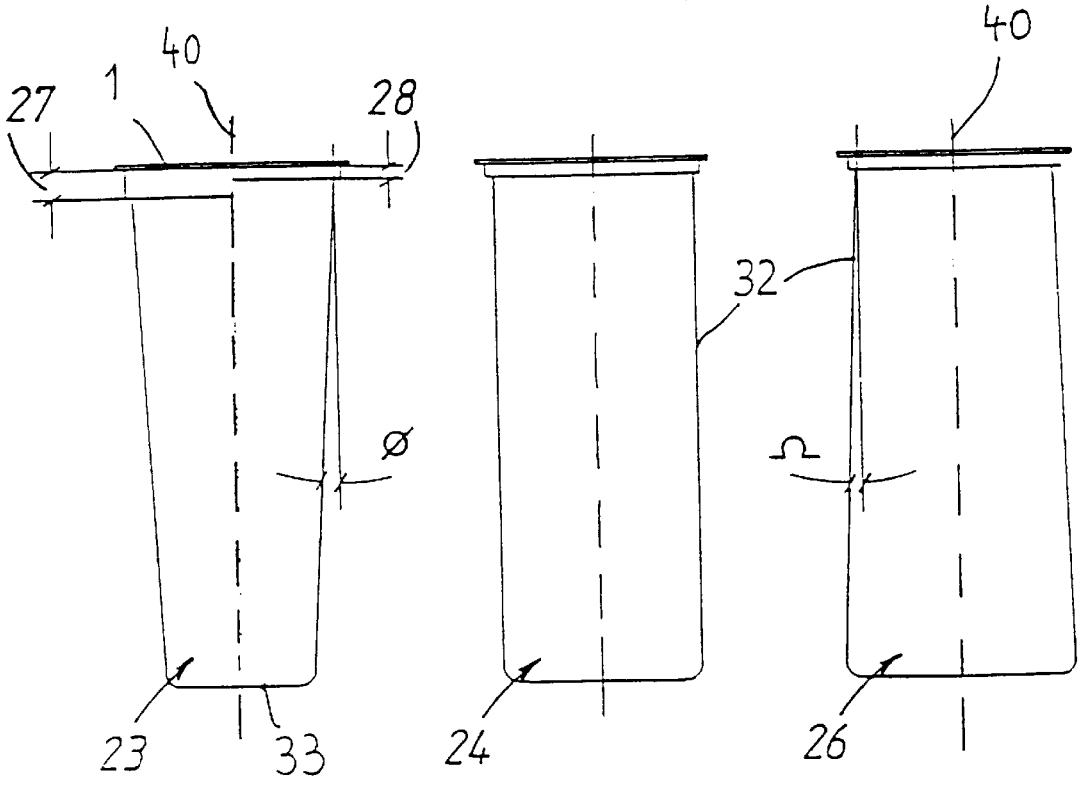
Figures 12, 13:
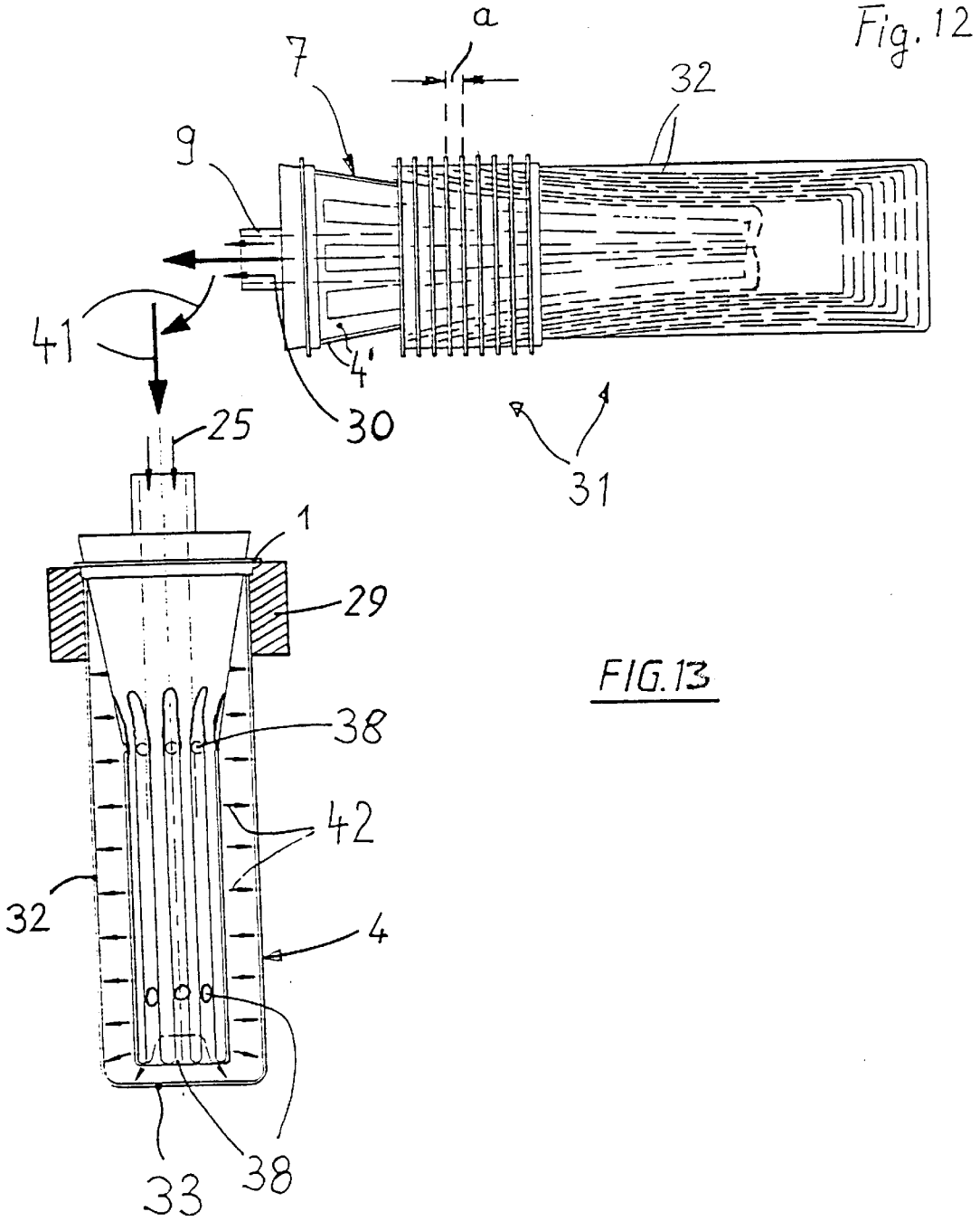

Further advantages, features and possibilities for application of the present invention will be evident from the following description of preferred embodiments with reference to the attached drawings. These show, in:

FIG. 1 a densely packed stack with cup-shaped containers,

FIG. 2 a cross-section view through the stack along the line A—A of FIG. 1, FIG. 3 mandrel with a cup-shaped container drawn onto it in the expanded state and a folded cup-shaped container, which has come to lie on the surface of the mandrel, FIG. 4 a cross-section view of FIG. 3 along the line B—B, FIG. 5 schematically, the cross-section of a container which is not folded on the outside, with its folded state inside, FIGS. 6 to 8 comparable representations of the cross-section of the cup-shaped container with cross-sections other than represented in FIG. 5, FIG. 9 the side view of a first embodiment of a conical cup-shaped container with a left-hand embodiment with a different collar to the one in the right-hand embodiment, FIG. 10 a side view comparable with FIG. 9, of a cup-shaped container with a cylindrical wall, FIG. 11 another further embodiment of a container in a similar view to that of FIG. 10, but with a negative cone angle, FIG. 12 a mandrel inserted in a stack of cup-shaped containers for de-stacking, and FIG. 13 a mandrel inserted into a holder and the expanded cup-shaped container located thereon.

The stack 31 shown in FIGS. 1 and 12 is composed of cup-shaped containers 6 coaxially inserted one inside another, each with a side wall 32, at one end of which a base 33 is arranged, and at the other end a flange 1. For better description of the invention a differentiation is made between an inner cup-shaped container 2 (FIG. 1) and an outer cup-shaped container 4. The flange 1, and therewith the cup-shaped containers 2, 4, 6 are located in the stack 31. The small distance apart of the flanges is between 0 and 5 mm.

In FIG. 1, the inner cup-shaped container 2 is shown partly removed from the stack 31. The outer cup-shaped container 4 is in a non-folded state, which also corresponds to the expanded state or state as manufactured. The degree of folding increases towards the inside with an increased number of containers inserted one inside another. This can clearly be seen in the cross-section of FIG. 2. However, even the inner folded cup-shaped container 2 is folded without distortion, bending or twisting, particularly when the example of flexible plastics material of the type described above is complied with.

When a controlled spacing, for example in the sense of the distance a, is necessary to provide the stack 31 with, for example, a tidy or neat appearance, or to make possible the gripping of the flange 1 of the inner folded cup-shaped container 2 manually or with a special machine part, so that the container 2 can easily be removed from the stack 31, a collar 5 is provided on the respective "container 2, 4 6, for example, as a de-stacking collar.

FIG. 2 shows a mandrel 7 made hollow with an air line 9, on the surface of which each container 2, 4, 6 which will be combined, for example, into the stack 31, can be folded in a controlled manner. When the side wall 32 and respectively the base 33 have been laid on the surface of the mandrel 7, the cup-shaped container 2, 4, 6 can be introduced into the inside of the stack 31 of FIG. 1, in the direction opposite to the direction of removal 37.

According to FIGS. 3 and 4 a cup-shaped container 4, not yet folded, for example an outer one, with the flange 1, is pulled onto the mandrel 7. The annular flange 1 lies in a sealing manner on the conical section 8 of the mandrel, which makes up approximately ⅓ of the active length L of the mandrel 7. The remaining ⅔ are taken up by the cylindrical section 12. In this way the flange 1 forms a seal in the contact position on the cone shaped section 8 of the mandrel 7. From the end face 34, the air line 9 enters from the outside into the mandrel 7, bifurcates on the cylindrical section 12 of the mandrel 7 and terminates there at the mouth apertures 38.

Using means not shown, a vacuum can be applied to this mandrel 7 through its air line 9, or a positive air pressure can be applied to the outside of the cup-shaped container 4 such that a sufficient pressure differential is created to fold the side wall 32 of the container 4 on the surface of the mandrel 7 and to keep it there.

FIG. 4 shows a cross-section in an intermediate state, where the side wall 13 of the folded cup-shaped container 4' has just been brought to lie on the cylindrical section 12 of the mandrel 7, but has not yet completely arrived in the grooves 14 of the section 12. In addition, the base 33 is drawn into the corresponding indented part of the mandrel is drawn in, as shown by the arrows 39 in FIG. 3, and by the drawn in part of the base 33' of the container 4'.

After the folded cup-shaped container 4' has come to lie completely on the mandrel 7, the mandrel 7 with the folded container 4' can be removed from a container shaping machine and transported to the stack 31. Here, the mandrel with the folded cup-shaped container 2, 4' 6 located on it is transported onto the open end of the stack, as already described, in the direction opposite the arrow 37 in FIG. 1, from left to right.

The pressure differential, which applies an increased pressure outside the side wall 32 and a reduced pressure inside the same, is maintained until complete entry of the occupied mandrel into the stack 31, such that the cup-shaped container in its folded state is held on the mandrel. After complete entry of the occupied mandrel into the stack 31, this pressure differential is switched so that the pressure drop is countered such that inside the side wall 32 the pressure is greater, and outside is lower, with the result that the folded cup-shaped container is blown up or expanded again. In this way it is brought into effective contact with the inner surface of the side wall 32 of the previously inserted, next outer folded cup-shaped container in the stack. In this way the mandrel 7 is free and can be withdrawn and again guided to the container manufacturing machine to receive the next cup-shaped container. The sequence repeats in that the pressure differential firstly described is switched on again, with a drop in pressure from the outside to the inside, and so forth.

If FIGS. 3 and 4 are considered, and the geometry of the mandrel 7 with the conical section 8 and the cylindrical section 12 and the grooves 14, the overall dimensions of the mandrel 7 are selected such that the surface of the folded container 2, 4' 6 (including its base 33) comes to lie completely on the surface of the mandrel, configured in the manner described. In other words, the total surface, for example, the circumferential length of the non-folded, expanded container, is naturally the same size as that of the folded container, so the surface over the active length L of the mandrel 7 has the same value, with the result that over the circumference of a cup-shaped container 2, 4' 6 folded in this manner substantially no folds or creases occur.

Advantageously uncontrolled or even damaged folds or creases in the longitudinal direction of the folded cup-shaped container 6 can be prevented by the grooves 14 of the cylindrical section 12. When another such shape, for example with purely cylindrical walls has to be processed instead of a conical container, a mandrel geometry configured correspondingly differently is recommended.

FIGS. 5 to 8 show a number of different cross-section shapes of cup-shaped containers and their relationship to the preferred shape of the most folded (for example, the inner) cup-shaped container in the stack 31. In the schematic representation, the outside line always means the cross-section shape of the expanded container and the inside line the cross-section shape of a container 6 located completely in the inside of a stack 31, as can be seen, for example, in the middle of FIG. 2.

According to FIG. 5 a cup-shaped container with a generally circular cross-section 15 would assume the evenly corrugated shape according to the line 16. The surface can also be described as limp with a certain stiffness, or the individually corrugated grooves also in the cross-section view of line 16 can be described as lobes, so the line 16 represents a cross-section with a number of lobes distributed over the approximately circular circumference.

FIG. 6 shows a cup-shaped container with a triangular cross-section according to the line 17, in the expanded state, which produces a shape with generally three lobes through the folding, as shown by the line 18 with the cross-section of the three lobes.

A cup-shaped container with a square cross-section according to line 19 as in FIG. 7 produces an external cross-section through folding as shown in 20, that is to say a cross-section of a shape with four lobes.

In FIG. 8, lastly as the fourth example a cup-shaped container is shown with a hexagonal cross-section according to the line 21. By folding, this cross-section produces a cross-section with six lobes according to the undulating line 22 in FIG. 8.

In FIGS. 9 to 11 three examples of different container geometries are shown in a side view. In each case the direction of the longitudinal centre line 40 is viewed, that is to say with the direction of viewing being perpendicular to the paper, on the side wall 32 of the respective cup-shaped container.

According to FIG. 9, a cup-shaped container of the conical type 23 is shown. Here, the diameter in the proximity of the flange 1 is greater than on the base 33, that is to say the side wall 32 tapers towards the base and has a positive cone angle $\phi$. Moreover in FIG. 9 on the left-hand side of the dashed line which represents the longitudinal centre line 40 of the cup-shaped container, a collar 27 moulded near to the flange is shown, which ensures a spacing a of, for example, 5 mm of one container from the next in the stack 31. On the right-hand side of the dashed line a much shorter collar 28 is shown, with which the stack 31 can be packed much more tightly because the distance a, the indexing distance, is reduced, for example, by half.

The embodiments according to FIGS. 9 to 11 are deep drawn from plastics polymer in one piece, so the flange 1 as well as the base 33 is composed from one piece with the collar 27, 28 and the side wall 32.

In FIG. 10 a cup-shaped container of the cylindrical type 24 is shown with a cone angle of 0. Until now such containers were not stackable. The combining into a stack 31 according to FIG. 1 is now possible by means of the measures according to the invention also with cup-shaped containers having the configuration according to FIG. 10.

In FIG. 11, a third example of a configuration of a cup-shaped container is shown wherein in this case a container of the over-shaped conical type 26 is shown, that is to say a cone with a negative cone angle $\Omega$. Even this configuration of a container can be processed to form a stack 31 according to the FIG. 1.

In each of the three cases shown in FIGS. 9 to 11, the respective inner folded cup-shaped container 6 can be removed from the stack 31 without at the same time bringing with it the next or even several outer containers. The force of contact between the inner and the adjacent outer container and therefore also the surface friction of these two adjacent cup-shaped containers is less than the force of contact and the surface friction of this next container, sitting on its outside, as already described above. For this reason, when de-stacking the container types 23, 24 and 26, multiple removal is always avoided.

FIGS. 12 and 13 show how a mandrel 7 can be used for de-stacking. In FIG. 12 on the right-hand side there is again a stack 31 of cup-shaped containers with the small indexing distance a. In this case the mandrel 7 is inserted from the left to the right into the open end of the stack 31 until the mandrel 7 has reached the end position at which sealing between the flange 1 of the inner container 4' and the conical section 8 of the mandrel 7 is possible on one side and the base 33 of the container comes to lie close to the other end of the mandrel 7. A vacuum is then applied, that is to say air is evacuated according to the arrows 30 from the air line 9 and thereby from the inside of the inner container. This container is thereby folded, comes into complete contact with the mandrel 7 and is thereby held by it. FIG. 12 shows the mandrel 7 with a container 4' partially removed from the stack.

The mandrel covered by the container 4' can now be removed from the stack 31 and, for example, conveyed in the direction of transport according to the arrow 41 into the holder 29 of a container loading station of a filling machine. If the mandrel has reached the state shown in FIG. 13 (before the folded cup-shaped container 4 is expanded), the flange 1, for example, rests on the inner edge of the annular surface of the holder 29 and can be easily manipulated from there. The drop in pressure is not switched, that is to say compressed air is introduced in the direction of the arrows 25 into the air line 9, the air comes out of the mouth apertures 38 into the grooves 14 and expands the folded cup-shaped container (4' in FIG. 12) in the state shown in FIG. 13 by the solid line, where the expanded container is labelled 4. The number of arrows 42 shows the direction of flow of the compressed air in the inside of the cup-shaped container 4, is that it is expanded into the shape shown in FIG. 13.

We claim:

1. A stack of cup-shaped containers (2, 4, 6) coaxially inserted one inside another, each with a side wall (32), on one end of which a base (33) is arranged, and on the other end a flange (1), wherein the container (2, 4, 6) is composed of a flexible material and the flange (1) is substantially stiffer than the side wall (32) and base (33), characterised in that apart from the outermost cup-shaped container (4), each inner container (2) is partially radially folded, and that the degree of folding gradually increases towards the innermost cup-shaped container (2).

2. Stack according to claim 1, characterised in that each inner cup-shaped container (2) has longitudinal folds (3) in its side wall (32), distributed over its circumference and at the open end the flange (1).

3. Stack according to claim 1 or 2, characterised in that the longitudinal folds (3) in the side wall (32) of the cup-shaped container (2, 4, 6) begin at its open end at the flange (1) and extend to the base (33) of the container (2, 4, 6), and that the average diameter of the respective inner container (2) of a stack (31) is smaller because of the folding and the geometry changed by this, than the average diameter of the adjacent outer container (4).

4. Stack according to one of claims 1 to 2, characterised in that a lubricant is present on the plastics surface of the cup-shaped container (2, 4, 6).

5. Stack according to one of claims 1 to 2, characterised in that on the flange (1) of the cup-shaped container (2, 4, 6) a collar (5) is arranged, facing its side wall (32).

6. Stack according to one of claims 1 to 2, characterised in that the longitudinal folds (3) are substantially evenly distributed on the circumference, in the side wall (32) of the cup-shaped container (2, 4, 6), and are rounded in a corrugated manner in cross-section.

7. Stack according to one of claims 1 to 2, characterised in that the cup-shaped container (2) has, in the expanded state, has an approximately cylindrical or a conically tapered side wall (32).

8. Method for manufacturing a stack (31) of cup-shaped containers (2, 4, 6) coaxially inserted one inside another, each with a side wall (32), on one end of which a base (33) is arranged, and on the other end a flange (1), wherein the container (2, 4, 6) is composed of a flexible material and the flange (1) is substantially stiffer than the side wall (32) and base (33), characterised in that between the inside and the outside of the side wall (32) of the cup-shaped container (2, 4, 6) a pressure drop is created such that the side wall (32) of the container (2, 4, 6) comes to lie in a folded state on a mandrel (7), the pressure differential is maintained and during this the mandrel (7) is moved with the folded container (2, 4, 6) on it into a holder, after which the pressure differential is reversed, in this way the container is expanded again, and the empty mandrel (7) removed from the expanded container (4, 6), after which the procedure is repeated and one container (2, 4, 6) after another is moved into the respective previous inner container (2, 6).

9. Method according to claim 8, characterised in that the average diameter of the folded side wall (32) of the cup-shaped container (2, 6) is reduced by the pressure differential by at least 40% of the diameter of the expanded container (4, 6).

10. Method for de-stacking cup-shaped containers (2, 4, 6) coaxially inserted one inside another, each with a side wall (32), on one end of which a base (33) is arranged, and on the other end a flange (1), wherein the container (2, 4, 6) is composed of a flexible material and the flange (1) is substantially stiffer than the side wall (32) and base (33), from a stack (31) of containers, characterised in that between the inside and the outside of the side wall (32) of the cup-shaped container (2, 4, 6) a pressure drop is created such that the side wall (32) of the innermost container (2, 6) comes to lie in a folded state on a mandrel (7), the pressure differential is maintained and during this the mandrel (7) is moved with the folded container (2, 4, 6) on it out of the stack (31) and is transported to a processing station, after which the pressure drop is reversed and the container (2, 6) is expanded to its geometrical configuration as manufactured, after which the empty mandrel (7) is removed from the expanded container (4, 6), and after which the procedure is repeated and one container (2, 4, 6) after another is removed from the stack and transported to the processing station.

11. Method according to claim 10, characterised in that the average diameter of the folded side wall (32) of the cup-shaped container (2, 4, 6) is reduced by the pressure differential by at least 40% of the diameter of the expanded container (4, 6).

12. Device for de-stacking cup-shaped containers, with a mandrel (7) and a holder (29) for cup-shaped containers (2,4,6) moveable relative to the mandrel (7), characterised in that the mandrel (7) has a first section (8) with a conical surface and a second section (12) with a cylindrical surface, that the length of the conical section (8) is ¼ to ½ the active length (L) of the mandrel, and that the conical section (8) has a substantially smooth surface.

13. Device according to claim 12, characterised in that in the mandrel (7) there is provided an air line (9) coming from an end face (34), bifurcated at the cylindrical section (12) and opening out in the surface of the cylindrical section (12).

14. Device according to claim 12 or 13, characterised in that the surface of the cylindrical section (12) grooves (14) are arranged, running in the longitudinal direction of the mandrel (7) symmetrically distributed about its circumference, and that the respective bifurcation of the air line (9) opens out in the base of the groove (14).

15. Device according to one of claims 12 to 13, characterised in that the overall circumferential length of the cylindrical section (12) of the mandrel (7), inclusive of its longitudinal grooves, is dimensioned so that the cup-shaped container (2, 4, 6) can be brought into contact on its circumferential length.

16. Device for manufacturing a stack (31) of cup-shaped containers (2,4,6), with a mandrel (7) and a holder (29) for cup-shaped containers (2,4,6) moveable relative to the mandrel (7), characterised in that the mandrel (7) has a first section (8) with a conical surface and a second section (12) with a cylindrical surface, that the length of the conical section (8) is ¼ to ½ the active length (L) of the mandrel, and that the conical section (8) has a substantially smooth surface.

* * * * *